US009299288B2

(12) United States Patent
Sun et al.

(10) Patent No.: US 9,299,288 B2
(45) Date of Patent: Mar. 29, 2016

(54) ORGANIC LIGHT EMISSION DIODE DISPLAY DEVICE DRIVING CIRCUIT INCLUDING A CHARGING CIRCUIT

(71) Applicant: CHUNGHWA PICTURE TUBES, LTD., Taoyuan (TW)

(72) Inventors: Bo-Jhang Sun, Kaohsiung (TW); Chin-Hai Huang, Taoyuan County (TW); Szu-Chi Huang, Changhua County (TW)

(73) Assignee: CHUNGHWA PICTURE TUBES, LTD., Taoyuan (TW)

( * ) Notice: Subject to any disclaimer, the term of this patent is extended or adjusted under 35 U.S.C. 154(b) by 162 days.

(21) Appl. No.: 14/051,453

(22) Filed: Oct. 11, 2013

(65) Prior Publication Data

US 2014/0362068 A1 Dec. 11, 2014

(30) Foreign Application Priority Data

Jun. 11, 2013 (TW) ..... 102120749 A

(51) Int. Cl.
*G09G 3/32* (2006.01)

(52) U.S. Cl.
CPC ..... *G09G 3/3233* (2013.01); *G09G 3/3283* (2013.01); *G09G 2300/0842* (2013.01); *G09G 2310/02* (2013.01); *G09G 2320/043* (2013.01)

(58) Field of Classification Search
CPC ..... G09G 2300/0842; G09G 2310/02
See application file for complete search history.

(56) References Cited

U.S. PATENT DOCUMENTS

| | | | | |
|---|---|---|---|---|
| 6,778,151 | B2 | 8/2004 | Li | |
| 2001/0019327 | A1* | 9/2001 | Kim et al. | 345/204 |
| 2006/0050040 | A1 | 3/2006 | Chou | |
| 2008/0211746 | A1* | 9/2008 | Caligiore et al. | 345/76 |
| 2010/0253608 | A1* | 10/2010 | Kim et al. | 345/76 |

FOREIGN PATENT DOCUMENTS

| | | | |
|---|---|---|---|
| CN | 1405750 | A | 3/2003 |
| CN | 1523559 | A | 8/2004 |
| CN | 1991942 | A | 7/2007 |
| CN | 101197112 | A | 6/2008 |
| JP | 2007-206590 | A | 8/2007 |
| JP | 2011107441 | A | 6/2011 |
| KR | 2008-0082820 | A | 9/2008 |
| TW | 200417970 | A | 9/2004 |
| TW | 200421240 | A | 10/2004 |
| TW | 200525478 | A | 8/2005 |

(Continued)

*Primary Examiner* — Quan-Zhen Wang
*Assistant Examiner* — Chun-Nan Lin
(74) *Attorney, Agent, or Firm* — CKC & Partners Co., Ltd.

(57) ABSTRACT

A driving circuit includes a first transistor, a capacitor, a second transistor, and a charging circuit. The input terminal of the first transistor is electrically connected to a voltage source. The output terminal of the first transistor is electrically connected to an organic light-emitting diode. The first terminal of the capacitor is electrically connected to the control terminal of the first transistor. The input terminal of the second transistor is electrically connected to the second terminal of the capacitor. The control terminal of the second transistor is electrically connected to a scan line. The output terminal of the second transistor is electrically connected to the output terminal of the first transistor. The charging circuit is electrically connected to the first and second terminals of the capacitor, the scan line, and a current source.

5 Claims, 2 Drawing Sheets

(56) References Cited

FOREIGN PATENT DOCUMENTS

| | | | |
|---|---|---|---|
| TW | 200537400 | A | 11/2005 |
| TW | I249721 | | 2/2006 |
| TW | 200614118 | A | 5/2006 |
| TW | 200731202 | A | 8/2007 |
| TW | 201030719 | A | 8/2010 |
| TW | 201110088 | A | 3/2011 |
| TW | I365433 | | 6/2012 |

* cited by examiner

ORGANIC LIGHT EMISSION DIODE DISPLAY DEVICE DRIVING CIRCUIT INCLUDING A CHARGING CIRCUIT

RELATED APPLICATIONS

This application claims priority to Taiwanese Application Serial Number 102120749, filed Jun. 11, 2013, which is herein incorporated by reference.

BACKGROUND OF THE INVENTION

1. Field of Invention

The present invention relates to a driving circuit and, more particularly, to a driving circuit of a organic light emitting diode.

2. Description of Related Art

Display panels utilizing current coded mode comprise at least two driving periods. One is a data writing (current programming) period. In this period, a capacitor of a driving circuit is charged by a data current, that is to say, a data voltage is written into the capacitor. The other is a light emitting period. In this period, the display panel controls the displaying brightness thereof according to the data voltage written into the capacitor.

In the foregoing data writing period, the data current can be written into the capacitor in a short time when the data current is large. Consequently, conditions associated with the data writing period are not affected. However, the data current is relatively small when the display panel needs to display a low gray level such that the time in which the data current is written into the capacitor increases substantially. As a result, the duration of the data writing period is increased substantially, and furthermore, the operation of writing data may fail.

SUMMARY OF THE INVENTION

One objective of the present invention is to provide a driving circuit. Through use of configurations and operations of the driving circuit, the problem of the time in which data current is written into a capacitor increasing substantially due to the data current being small when the display panel needs to display a low gray level is addressed. Furthermore, the duration of the data writing period can be controlled to within a time limitation to avoid data writing failure.

For achieving said purpose, one aspect of the present invention is related to a driving circuit for driving an organic light emitting diode in a display panel. The display panel comprises a plurality of scan lines. The driving circuit comprises a first transistor, a capacitor, a second transistor, and a charging circuit. The first transistor comprises an input terminal, a control terminal, and an output terminal. The capacitor comprises a first terminal and a second terminal. The second transistor comprises an input terminal, a control terminal, and an output terminal. With respect to structure, the input terminal of the first transistor is electrically coupled to a voltage source, and the output terminal of the first transistor is electrically coupled to the organic light emitting diode. The first terminal of the capacitor is electrically coupled to the control terminal of the first transistor. The input terminal of the second transistor is electrically coupled to the second terminal of the capacitor, the control terminal of the second transistor is electrically coupled to one of the scan lines, and the output terminal of the second transistor is electrically coupled to the output terminal of the first transistor. The charging circuit is electrically coupled to the first terminal and the second terminal of the capacitor, one of the scan lines, and a current source.

In one embodiment of the present invention, the second transistor is turned off according to a first scanning signal provided by one of the scan lines during a data writing period, and the charging circuit is turned on according to the first scanning signal transmitted by one of the scan lines to charge the capacitor during the data writing period.

In another embodiment of the present invention, the first scanning signal is a low level signal.

In yet another embodiment of the present invention, the charging circuit charges the capacitor according to a first current provided by the current source during the data writing period.

In still another embodiment of the present invention, the second transistor is turned on according to a second scanning signal provided by one of the scan lines during a light emitting period such that the capacitor provides a charge voltage to the control terminal and the output terminal of the first transistor.

In yet another embodiment of the present invention, the second scanning signal is a high level signal.

In still another embodiment of the present invention, the first transistor drives the organic light emitting diode according to the charge voltage during the light emitting period.

In yet another embodiment of the present invention, the charging circuit comprises a third transistor and a fourth transistor. The third transistor comprises an input terminal, a control terminal, and an output terminal. The fourth transistor comprises an input terminal, a control terminal, and an output terminal. With respect to structure, the control terminal of the third transistor is electrically coupled to one of the scan lines, and the output terminal of the third transistor is electrically coupled to the current source. The input terminal of the fourth transistor is electrically coupled to the voltage source, the control terminal of the fourth transistor is electrically coupled to the second terminal of the capacitor, and the output terminal of the fourth transistor is electrically coupled to the input terminal of the third transistor.

In still another embodiment of the present invention, the voltage source provides a second current to the organic light emitting diode during the light emitting period, wherein a relation between the second current and the first current provided by the current source is as follows:

$$I_{OLED} = \frac{K_n}{K_p} \times I_{data},$$

where $I_{OLED}$ is the second current, $K_n$ is a conduction parameter of the first transistor, $K_p$ is a conduction parameter of the fourth transistor, and $I_{data}$ is the first current.

In yet another embodiment of the present invention, the charging circuit further comprises a fifth transistor. The fifth transistor comprises an input terminal, a control terminal, and an output terminal. With respect to structure, the input terminal of the fifth transistor is electrically coupled to the input terminal of the fourth transistor and the voltage source, the control terminal of the fifth transistor is electrically coupled to one of the scan lines, and the output terminal of the fifth transistor is electrically coupled to the first terminal of the capacitor.

DETAILED DESCRIPTION

Figure 1:
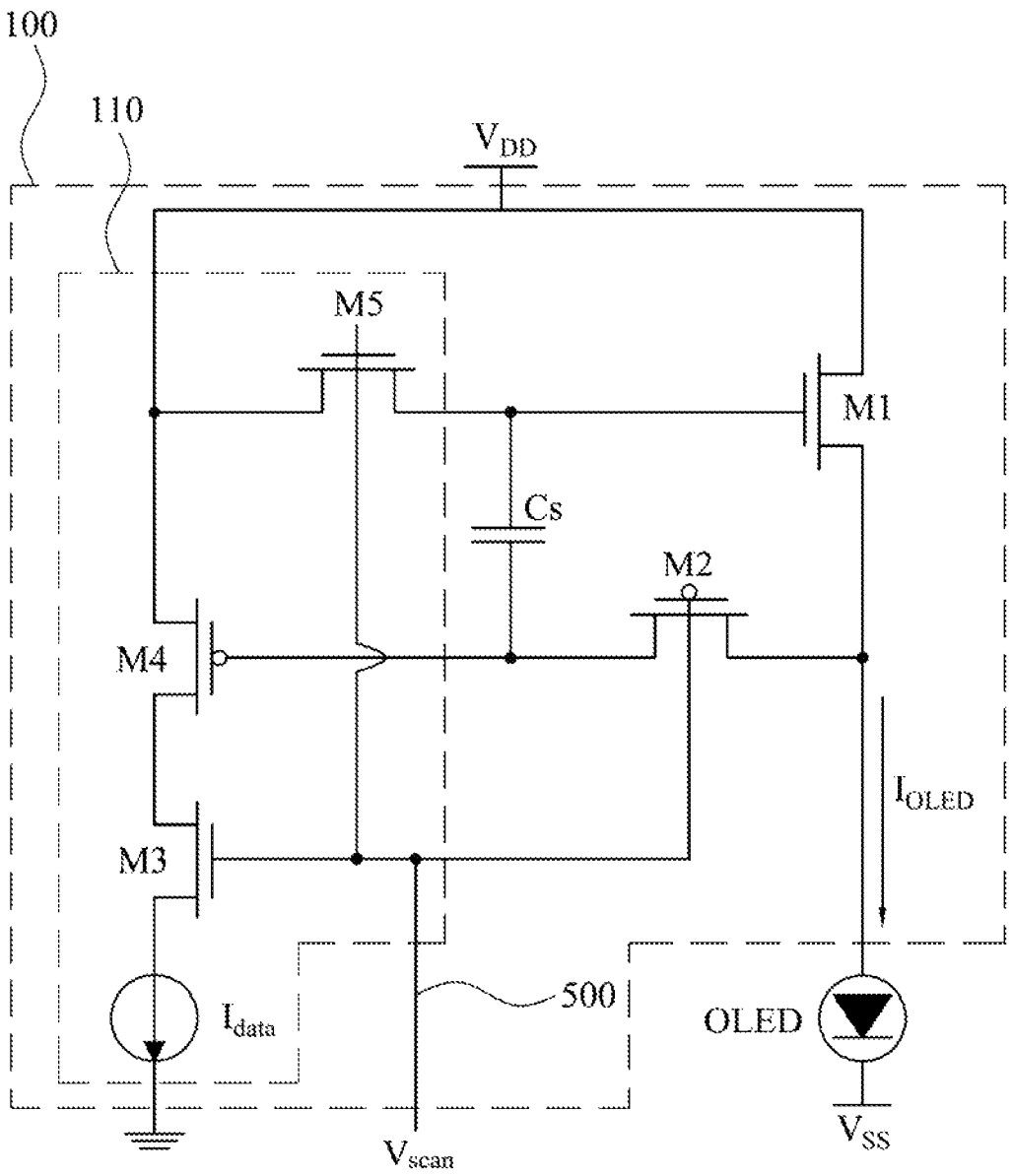
FIG. 1 schematically shows a diagram of a driving circuit according to embodiments of the present invention.

For solving problems existing in the prior art, the present invention provides an innovative driving circuit, and the driving circuit is shown in FIG. 1. As shown in FIG. 1, the driving circuit 100 comprises a first transistor M1, a capacitor $C_s$, a second transistor M2, and a charging circuit 110. The first transistor M1 comprises an input terminal, a control terminal, and an output terminal. The capacitor $C_s$ comprises a first terminal and a second terminal. The second transistor M2 comprises an input terminal, a control terminal, and an output terminal.

With respect to structure, the input terminal of the first transistor M1 is electrically coupled to the voltage source $V_{DD}$, and the output terminal of the first transistor M1 is electrically coupled to an organic light emitting diode OLEO. The first terminal of the capacitor $C_s$ is electrically coupled to the control terminal of the first transistor M1. The input terminal of the second transistor M2 is electrically coupled to the second terminal of the capacitor $C_s$, the control terminal of the second transistor M2 is electrically coupled to a scan line 500, and the output terminal of the second transistor M2 is electrically coupled to the output terminal of the first transistor M1. The charging circuit 110 is electrically coupled to the first terminal of the capacitor $C_s$, the second terminal of the capacitor $C_s$, the scan line 500, and a current source $I_{data}$.

When implementing the present invention, each of the foregoing transistors can be a Bipolar Junction Transistor (BJT), a Metal-Oxide-Semiconductor Field-Effect Transistor (MOSFET), an Insulated Gate Bipolar Transistor (IGBT), and so on, but the present invention is not limited. In FIG. 1, MOSFETs are used as an example to illustrate the structure of the present invention. Moreover, odd number transistors among the transistors (for example, the first transistor M1) are N-type transistors, while even number transistors among the transistors (for example, the second transistor M2) are P-type transistors. However, the scope of the present invention is not intended to be limited, and those skilled in the art can selectively adopt appropriate elements to accomplish the present invention based on actual requirements within the spirit of the present invention.

By the use of the structure of the driving circuit 100, the driving circuit 100 addresses the problem of the time in which the data current being written into the capacitor increasing substantially due to the data current being small when the display panel utilizing current coded mode needs to display a low gray level.

Figure 2:
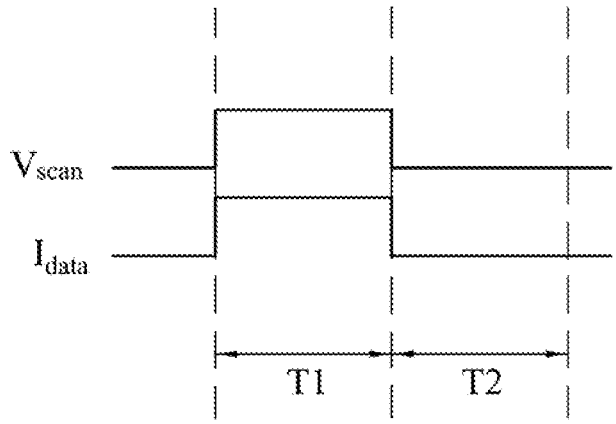
FIG. 2 schematically shows a diagram of a driving waveform according to embodiments of the present invention.

For further introducing an operation mode of the driving circuit provided by the present invention, reference is now made to FIG. 2 which schematically shows a diagram of a driving waveform. As shown in FIGS. 1 and 2, in a data writing period T1, a first scanning signal $V_{scan}$ provided by the scan line 500 is a high level signal $V_{scan\text{-}high}$. The second transistor M2 is turned off according to the scanning signal provided by the scan line 500, and the charging circuit 110 is turned on according to the scanning signal provided by the scan line 500. Hence, the second terminal of the capacitor $C_s$ and the output terminal of the first transistor M1 are electrically isolated from each other. At this time, the charging circuit 110 charges the capacitor $C_s$.

Specifically, in the data writing period T1, the charging circuit 110 charges the capacitor $C_s$ according to a current provided by the current source $I_{data}$. With continued reference to FIGS. 1 and 2, in a light emitting period T2, the second scanning signal $V_{scan}$ provided by the scan line 500 is a low level signal $V_{scan\text{-}low}$. The second transistor M2 is turned on according to the scanning signal provided by the scan line 500 such that the capacitor $C_s$ provides a charge voltage $V_{CS}$ to the control terminal and output terminal of the first transistor M1. At this time, $V_{GS}$ of the first transistor M1 is equal to the charge voltage $V_{CS}$ provided by the capacitor $C_s$. The first transistor M1 can drive the organic light emitting diode OLEO according to the charge voltage $V_{CS}$.

In addition, referring to FIG. 1, the charging circuit 110 comprises a third transistor M3 and a fourth transistor M4. The third transistor M3 comprises an input terminal, a control terminal, and an output terminal. The fourth transistor M4 comprises an input terminal, a control terminal, and an output terminal. With respect to structure, the control terminal of the third transistor M3 is electrically coupled to the scan line 500, and the output terminal of the third transistor M3 is electrically coupled to the current source $I_{data}$. The input terminal of the fourth transistor M4 is electrically coupled to a voltage source $V_{DD}$, the control terminal of the fourth transistor M4 is electrically coupled to the second terminal of the capacitor $C_s$, and the output terminal of the fourth transistor M4 is electrically coupled to the input terminal of the third transistor M3.

In this embodiment, the charging circuit 100 further comprises a fifth transistor M5. The fifth transistor M5 comprises an input terminal, a control terminal, and an output terminal. With respect to structure, the input terminal of the fifth transistor M5 is electrically coupled to the input terminal of the fourth transistor M4 and a voltage source $V_{DD}$, the control terminal of the fifth transistor M5 is electrically coupled to the scan line 500, and the output terminal of the fifth transistor M5 is electrically coupled to the first terminal of the capacitor $C_s$. As in the case of the other transistors discussed previously, in FIG. 1, MOSFETs are used as an example to illustrate the structure of the present invention. Moreover, odd number transistors among the transistors (for example, the third and fifth transistors M3, M5) are N-type transistors, while even number transistors among the transistors (for example, the fourth transistor M4) are P-type transistors. However, the scope of the present invention is not intended to be limited, and those skilled in the art can selectively adopt appropriate elements to accomplish the present invention based on actual requirements within the spirit of the present invention.

For further introducing effects achieved by the structure and operation of the driving circuit 100 of the present invention, reference is now made to the following description. In the data writing period T1, the fourth transistor M4 of the charging circuit 110 charges the capacitor $C_s$ according to a current provided by the current source $I_{data}$. A charge formula of the capacitor $C_s$ is follows:

$$V_{Cs} = \sqrt{\frac{I_{data}}{K_p}} + |V_{TH_M4}| \qquad \text{formula 1}$$

where $K_p$ is a conduction parameter of the fourth transistor M4, and $V_{TH_M4}$ is a threshold voltage of the fourth transistor M4.

With continued reference to FIGS. 1 and 2, in the light emitting period T2, the scanning signal $V_{scan}$ provided by the scan line 500 is a low level signal. The second transistor M2 is turned on according to the scanning signal provided by the scan line 500 such that the capacitor $C_s$ provides the charge voltage $V_{CS}$ to the control terminal and output terminal of the first transistor M1. Meanwhile, $V_{GS}$ f the first transistor M1 is equal to the charge voltage $V_{CS}$ provided by the capacitor $C_s$. The first transistor M1 can drive the organic light emitting diode OLED according to the charge voltage $V_{CS}$. The current of the OLED is related to the $V_{GS}$ of the first transistor M1. The formula of the current of the OLED is as follows:

$$I_{OLED}=K_n(V_{GS}-V_{TH_M1})^2 \quad \text{formula 2}$$

where $K_n$ is a conduction parameter of the first transistor M1, $V_{GS}$ is a voltage between the gate and the source of the first transistor M1, and $V_{TH_M1}$ is a threshold voltage of the first transistor M1.

Subsequently, in the foregoing light emitting period T2, because $V_{GS}$ of the first transistor M1 is equal to the charge voltage $V_{CS}$ provided by the capacitor $C_s$, the charge voltage $V_{CS}$ in formula 1 is substituted into an item of $V_{GS}$ of the first transistor M1 in formula 2, and the following formula is therefore obtained:

$$I_{OLED} = K_n\left(\sqrt{\frac{I_{data}}{K_p}} + |V_{TH_M4}| - V_{TH_M1}\right)^2 \quad \text{formula 3}$$

It is noted that a mismatch condition between the threshold voltage $VT_{TH_M4}$ in the charging circuit 100 and the threshold voltage $V_{TH_M1}$ in first transistor M1 only minimally affects $I_{OLED}$, and so the mismatch can be ignored. To prove that the mismatch between the threshold voltage of said circuits really minimally affects $I_{OLED}$, Smart-SPICE with Device Model (n/pmos level=36) therein is introduced to test the driving circuit 100, in which the following parameters are used: W/L_M3,5=8 μm/3.84 um (n-type), W/L_M2,4=8 μm/3.84 um (p-type), W/L_M1=50/3.84 um (n-type), $C_s$=0.6 pF, $V_{TH}$=1 or −1V, $I_{data}$=10 uA, $V_{scan_low}$=−10V, $V_{scan_high}$=28V, $V_{DD}$=10V, and $V_{SS}$=ground. The test results are as shown in FIG. 3 which schematically shows a test module diagram of a driving circuit according to embodiments of the present invention, where W is a width of a channel, L a length of a channel, $V_{scan_low}$ a low level signal, and $V_{scan_high}$ is a high level scanning signal.

Figure 3:
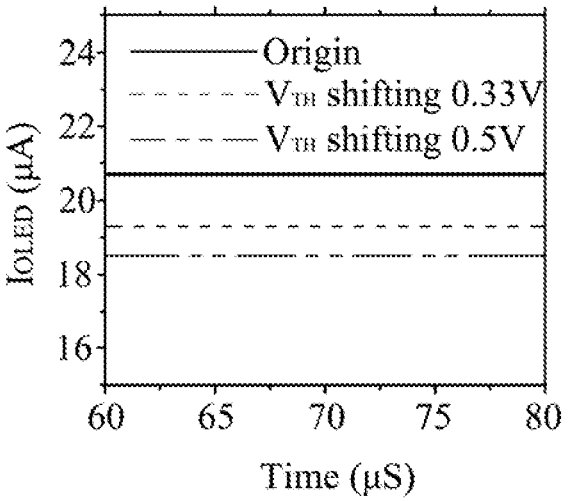
FIG. 3 schematically shows a test module diagram of a driving circuit according to embodiments of the present invention.

As shown in FIG. 3, the line marked by Origin is a threshold voltage $V_{TH}$ which is not shifted. The Error-Rate of the $I_{OLED}$ is merely 6.55% when the threshold voltage $V_{TH}$ is shifted by 0.33V, and the Error-Rate of $I_{OLED}$ is merely 10.41% when the threshold voltage $V_{TH}$ is shifted by 0.5V. As this illustrates, the shift of the threshold voltage $V_{TH}$ affects the $I_{OLED}$ only minimally, and therefore, the mismatch of the threshold voltage $V_{TH}$ in formula 3 can be ignored. In other words, the value of $|V_{TH_M4}-V_{TH_M1}|$ is smaller than the value of $$\sqrt{\frac{I_{data}}{K_p}},$$

and so the mismatch can be ignored. With this in mind, formula 3 can be arranged as follows to obtain formula 4:

$$I_{OLED} = \frac{K_n}{K_p} \times I_{data}, \quad \text{formula 4}$$

As is evident from formula 4, the driving circuit 100 of embodiments of the present invention can adjust the ratio between $I_{OLED}$ and $I_{data}$ by regulating $K_n$ and $K_p$. Hence, the driving circuit addresses the problem of the time in which the data current is written into the capacitor increasing substantially due to the data current being small when the display panel utilizing current coded mode needs to display a low gray level. Furthermore, the duration of the data writing period can be controlled to within a time limitation to avoid data writing failure. Moreover, when elements of the driving circuit 100 or the organic light emitting diode OLEO degrade, the degradation can be compensated by regulating $K_n$ and $K_p$.

What is claimed is:

1. A driving circuit for driving an organic light emitting diode in a display panel, wherein the display panel comprises a plurality of scan lines, and the driving circuit comprises:

a first transistor comprising:

an input terminal electrically coupled to a voltage source;

a control terminal; and an output terminal electrically coupled to the organic light emitting diode;

a capacitor comprising:

a first terminal electrically coupled to the control terminal of the first transistor; and a second terminal;

a second transistor comprising:

an input terminal electrically coupled to the second terminal of the capacitor;

a control terminal electrically coupled to one of the scan lines; and an output terminal electrically coupled to the output terminal of the first transistor; and a charging circuit electrically coupled to the first terminal and the second terminal of the capacitor, one of the scan lines, and a current source, wherein the second transistor is turned off according to a first scanning signal provided by one of the scan lines during a data writing period, and the charging circuit is turned on according to the first scanning signal transmitted by one of the scan lines to charge the capacitor during the data writing period, wherein the charging circuit charges the capacitor according to a first current provided by the current source during the data writing period, wherein the second transistor is turned on according to a second scanning signal provided by one of the scan lines during a light emitting period such that the capacitor provides a charge voltage across the control terminal and the output terminal of the first transistor, wherein the charging circuit comprises:

a third transistor comprising:

an input terminal;

a control terminal electrically coupled to one of the scan lines; and an output terminal electrically coupled to the current source; and a fourth transistor comprising:

an input terminal electrically coupled to the voltage source;

a control terminal electrically coupled to the second terminal of the capacitor; and an output terminal electrically coupled to the input terminal of the third transistor, wherein the voltage source provides a second current to the organic light emitting diode during the light emitting period, wherein a relation between the second current and the first current provided by the current source is as follows:

$$I_{OLED} = \frac{K_n}{K_p} \times I_{data}$$

where $I_{OLED}$ is the second current, $K_n$ is a conduction parameter of the first transistor, $K_p$ is a conduction parameter of the fourth transistor, and $I_{data}$ is the first current.

2. The driving circuit according to claim 1, wherein the first scanning signal is a low level signal.

3. The driving circuit according to claim 1, wherein the second scanning signal is a high level signal.

4. The driving circuit according to claim 1, wherein the first transistor drives the organic light emitting diode according to the charge voltage during the light emitting period.

5. The driving circuit according to claim wherein the charging circuit further comprises:

a fifth transistor comprising:

an input terminal electrically coupled to the input terminal of the fourth transistor and the voltage source;

a control terminal electrically coupled to one of the scan lines; and an output terminal electrically coupled to the first terminal of the capacitor.

* * * * *